US006430760B2

(12) United States Patent
Johns

(10) Patent No.: US 6,430,760 B2
(45) Date of Patent: Aug. 13, 2002

(54) FLUID HEATING APPARATUS AND METHODS FOR USING SAME

(76) Inventor: David Jessie Johns, 729 N. Golden State Blvd. #139, Turlock, CA (US) 95380

( * ) Notice: Subject to any disclaimer, the term of this patent is extended or adjusted under 35 U.S.C. 154(b) by 0 days.

(21) Appl. No.: 09/832,023

(22) Filed: Apr. 11, 2001

Related U.S. Application Data

(60) Provisional application No. 60/196,457, filed on Apr. 11, 2000.

(51) Int. Cl.[7] ..... A47K 3/28; B08B 3/00; F22B 1/16; F22B 37/04; F24C 13/00

(52) U.S. Cl. ..... 4/598; 4/603; 4/615; 122/40; 126/5; 126/59; 134/35; 134/37; 134/198

(58) Field of Search ..... 4/598, 596, 603, 4/615; 122/40, 105, 106; 126/5, 59; 134/35, 37, 198

(56) References Cited

U.S. PATENT DOCUMENTS

| | | | | | |
|---|---|---|---|---|---|
| 1,386,176 | A | | 8/1921 | Holmes | |
| 2,308,452 | A | | 1/1943 | Ortyl | 4/603 |
| 2,567,506 | A | | 9/1951 | Bowman | 4/598 |
| 2,567,614 | A | | 9/1951 | Merriam | 4/598 |
| 2,894,265 | A | | 7/1959 | Reardon | 4/615 |
| 3,293,664 | A | | 12/1966 | Coons | 4/599 |
| 3,332,091 | A | | 7/1967 | Greer | 4/603 |
| 3,431,565 | A | | 3/1969 | Nelson | 4/598 |
| 4,414,037 | A | * | 11/1983 | Friedheim | 134/35 |
| 4,809,369 | A | * | 3/1989 | Bowden | 4/615 |
| 5,299,329 | A | | 4/1994 | Constantini | 4/597 |
| 6,302,094 | B1 | * | 10/2001 | Wehrly | 126/5 |

* cited by examiner

*Primary Examiner*—Gregory Huson
*Assistant Examiner*—Kathleen J. Prunner
(74) *Attorney, Agent, or Firm*—Armstrong, Westerman & Hattori, LLP

(57) ABSTRACT

The apparatus for heating a fluid, such as water, as well as the method for using the apparatus are used in taking a personal shower or in cleaning an object. The apparatus includes an elongated tube formed of polymeric material and having two ends, one of the ends having a fitting attached thereto. The fitting is adapted to secure the apparatus in a fluid-tight manner to a source of a fluid flow. The other end of the tube has an applicator which includes one or more holes for the discharge of fluid flowing through the tube. A valve is disposed intermediate the ends of the tube. A portion of the elongated tube is formed into a coil which is disposed within a vessel. The coil is immersed in the liquid contained in the vessel. The vessel is disposed on a heating grate to heat water flowing through the tube.

12 Claims, 1 Drawing Sheet

FLUID HEATING APPARATUS AND METHODS FOR USING SAME

This application claims priority from provisional application Ser. No. 60/196,457, filed Apr. 11, 2000.

The present invention relates generally to an apparatus and method for heating a fluid such as water to an elevated temperature and, more particularly, to an apparatus and method for heating liquid such as water by heat exchange from another liquid such as water contained in vessel. The invention further relates to processes for using the above apparatus in providing, among other things, a portable personal shower for bathing purposes and a cleaning device for cleaning dirt, grime, stains and the like from various articles and surfaces.

While the apparatus and methods of the subject invention will be discussed primarily hereinafter with reference to particular embodiments and applications thereof, it is to be understood that the use and the application of the apparatus and method of the subject invention are not thereby so limited. For example, the apparatus according to the present invention may be useful in providing warm or hot water for showering purposes, particularly in an outdoor environment such as encountered in camping and the like situations. In addition, the benefits and advantages of the subject apparatus are equally applicable to the removal and/or cleaning of dirt, grime, stains, spots and the like from a wide variety of objects.

With regard to one application of the apparatus of the present invention mentioned above, persons who camp for relatively long periods in outdoor environments without conventional lodging facilities have a need for bathing. While typically sufficient amounts of water are available for bathing purposes while camping, it tends to be difficult to obtain a flow of warm water such that bathing by showering can be conducted comfortably. The water from most available natural water sources such as lakes and streams as well as most available running water from available taps tends to be colder than desired for most campers. As a consequence, many of those persons who camp either go through the considerable inconvenience of heating small quantities of water in a vessel over a fire or campstove for use in partial bathing and cleaning purposes or tend to forgo bathing entirely. Heating water in this fashion can be unsafe and inefficient and can present hygiene problems.

It is known in the art that portable showers can be provided which are capable of producing a flow of warm water sufficient for bathing purposes. For example, U.S. Pat. No. 3,431,565 to Nelson discloses a portable shower where water is pumped from a water container through a valve and then directly to a shower head. At the same time, water is pumped though a unit provided with a length of copper tubing or pipe wound into a helix, the interior of the unit being heated by a stove. The water heated in the unit is supplied to the valve which is then adjusted so the cold water and heated water are mixed to provide water through the shower heat at a suitable temperature for bathing. Also, U.S. Pat. 5,299,329 to Constantini discloses a hot water camping or other outdoor shower which is releasably mounted to a motor vehicle which utilizes water-to-water heat exchange though a heat exchanger mounted in-line with the vehicle heater core. Showering water is circulated from a source of water with an electric water pump through removable hoses.

A distinct disadvantage to the provisions described in these patents is that it is relatively expensive to manufacture the heating devices as they tend to be of a relatively complicated constructions, may require special materials and/or necessitate the use of large number of component parts. In addition, the disclosed devices tend to be cumbersome in regulating the temperature of the water to be used for showering purposes.

SUMMARY OF THE INVENTION

It therefore is a feature of the subject invention to provide a heating apparatus for a fluid such as water which is made of relatively inexpensive materials, is simple in its construction and requires and minimum number of component parts.

It also is a feature of the subject invention to provide a heating apparatus for a fluid such as water which is particularly adapted for use as an apparatus for heating water for purposes of providing a shower in outdoor environments such as when camping.

It is yet another feature of the subject invention to provide a heating apparatus for a fluid such as water which is particularly adapted for use as an apparatus for heating water for purposes of cleaning an object by applying hot water and/or steam to an area on the object to be cleaned.

It is a feature of the subject invention to provide a method for showering in an outdoor environment such as when camping which utilizes the heating apparatus of the present invention to provide the warm to hot water suitable for showering purposes.

It further is a feature of the subject invention to provide a method for cleaning an object which utilizes the heating apparatus of the present invention to apply hot water and/or steam to an area to be cleaned on the object.

Briefly, the present invention comprehends in its broader aspects an apparatus for use in heating a fluid, the apparatus comprising an elongated tube of polymeric material and having two ends, one of the ends having a fitting attached thereto, the fitting adapted to secure the apparatus in a fluid-tight manner to a source of a fluid flow, the other end of the tube having an applicator which includes one or more holes for the discharge of fluid flowing through the tube, and a valve intermediate the ends of the tube, a portion of the elongated tube being formed into a coil. the valve being located between the fitting and the coil.

The present invention also comprehends a method using the apparatus for taking a shower, the method comprising:

providing an apparatus for use in heating a fluid, the apparatus comprising an elongated tube of polymeric material and having two ends, one of the ends having a fitting attached thereto, the fitting adapted to secure the apparatus in a fluid-tight manner to a source of a fluid flow, the other end of the tube having an applicator which includes one or more holes for the discharge of fluid flowing through the tube, a valve intermediate the ends of the tube, a portion of the elongated tube being formed into a coil, the valve being located between the fitting and the coil, and a vessel which contains the portion of the tube formed into a coil along with a liquid;

heating the liquid in the vessel;

supplying fluid so as to flow through the tube from the fitting end to the applicator end;

applying the fluid emanating from the holes to a human.

The present invention also comprehends a method using the apparatus for cleaning a surface of an object, the method comprising:

providing an apparatus for use in heating a fluid, the apparatus comprising an elongated tube of polymeric material and having two ends, one of the ends having a fitting attached thereto, the fitting adapted to secure the apparatus in a fluid-tight manner to a source of a fluid flow, the other end of the tube having an applicator which includes one or more holes for the discharge of fluid flowing through the tube, a valve intermediate the ends of the tube, a portion of the elongated tube being formed into a coil, the valve being located between the fitting and the coil, and a vessel which contains the portion of the tube formed into a coil along with a liquid;

heating the liquid in the vessel;

supplying fluid so as to flow through the tube from the fitting end to the applicator end;

applying the fluid emanating from the holes to the surface of the object to be cleaned.

Further features, objects and advantages of the present invention will become more fully apparent from a detailed consideration of the arrangement of the steps and conditions of the subject processes as set forth in the following description when taken together with the accompanying drawings.

DETAILED DESCRIPTION OF THE PREFERRED EMBODIMENTS

Figure 1:
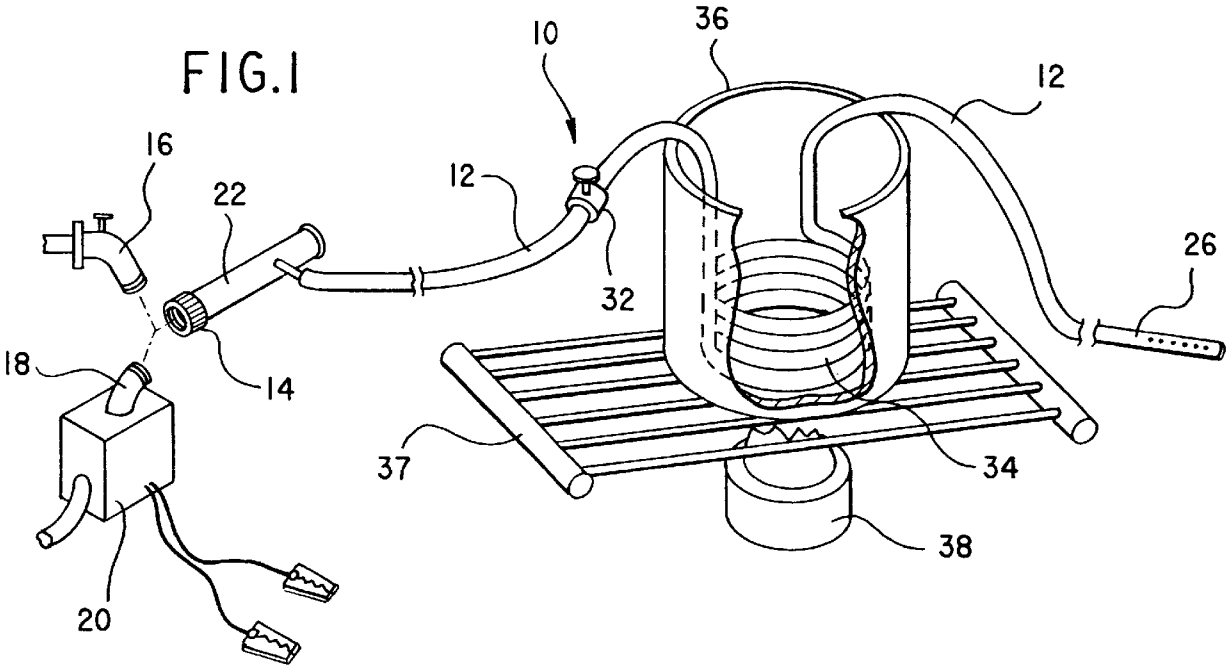
FIG. 1 is a perspective view of a portable heating apparatus in accordance with the present invention and which may be used in the methods of the subject invention.

The following is a description of embodiments of the present invention, with reference to the accompanying drawings. In the drawings, like components are indicated by like reference numerals.

As was previously mentioned, the subject invention is directed in one of its aspects to an apparatus for heating a fluid, preferably a liquid such as water. For the purposes of illustration only, the subject apparatus and methods for using same are described hereinafter with reference to a preferred of the apparatus as shown in the attached drawings.

Shown in FIG. 1 is apparatus 10 for heating of a liquid such as water and applying the heated liquid to an object so as to, for example, clean the object as will be explained in greater detail below. The apparatus 10 as illustrated includes a tube 12 of polymeric material and which is of considerable length, for example up to 100 feet or more. One end of the apparatus 10 is provided with a fitting 14 of a type adapted to be sealingly secured to a conventional water faucet 16 or the like, or to the output pipe 18 of a conventional liquid pump 20, or to a gravity feed source (not shown) such as an elevated bag, tank or the like. Fitting 14 of tube 12 allows the apparatus to be connected to a source of pressurized liquid such as water and allow the same to flow through the tube. Liquid pump 20 may be of various types of constructions which include a motor powered by, for example, electricity from a suitable source (not shown in this figure) such as a battery, household current, portable generator or the like.

Figure 2:
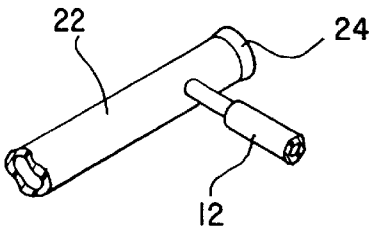
FIG. 2 illustrates in a detailed view an end portion of the apparatus shown in FIG. 1.

As is best shown in FIG. 2, fitting 14 is secured to a hose 22 of a relatively larger diameter than tubing 12. Tube 12 is secured to a hole in the sidewall of hose 22 by fitting (not shown). The end of hose 22 opposite from fitting is provided with plug 24 or the like to thereby close same. Crimping the hose 22 may suffice.

Figure 3:
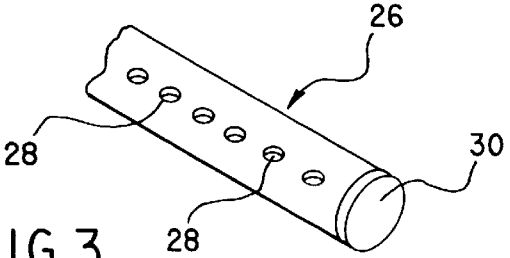
FIG. 3 illustrates in a detailed view another end portion of the apparatus shown in FIG. 1.

Secured to the other end of the tube 12 is an applicator 26 for applying the liquid which flows through the tube to the desired object. In the embodiment shown, particularly as shown in FIG. 3, applicator 26 includes of a plurality of holes 28 formed in a line on the side wall of tube 12 as well as plug 30 in the open end of the tube to close the same. Holes 28 are of a size which allow for the distribution of water flowing through tube 12 in the form of a spray. This applicator 26, by being open to the atmosphere, functions as a pressure relief for the apparatus 10, particularly tube 12.

Intermediate to the ends of the tube 12 and installed therein in the tube line is a valve 32 for controlling flow of fluid such as a liquid through the tube. Preferably, valve 32 is located in tube 12 before the tube enters a vessel so that venting of any pressure built up within the tube during heating thereof in the vessel is not blocked by the valve. Valve 32 can be of any convenient construction, but preferably is such that flow through the tube can be controlled in small increments for greater temperature control of the fluid emanating from the applicator 26.

It is a particular feature of the apparatus of the present invention that tube 12 is of a polymeric material as it has been found that metals are not suitable for use as the tube due to their high heat transfer characteristics. The polymeric materials for tube 12 may vary considerably but generally polyolefins such as polyethylene, polypropylene and copolymers thereof of preferred as long as the polymer is of the type which can maintain integrity at temperatures at about the boiling point of water or slightly above. A particularly preferred material for tube 12 is polyethylene and specifically preferred are polyethylene tubes of a relatively small diameter of about 0.25 in. to 0.5 in. which are typically used for irrigation purposes.

In use of the apparatus 10 in the illustrated embodiment, an intermediate portion of the tube 12 is formed into a coil 34 such as by wrapping the tube about itself a plurality of times and then securing the tube in the formed coil shape by a suitable means such as tape, wire, string and the like. For example, it has been found that a coil 34 which is about 3.5 inches high, has a diameter of about eight inches with a 3.5 inch hole in the center is particularly suitable for placing into a suitable vessel.

As shown, only the central portion of the tube 12 is included in the formed coil as the ends of the tube with fitting 14 and applicator 26 extending from the coil 34 project outwardly a considerable distance from the coil. The portion of the tube 12 in the form of coil 34 is placed within a vessel 36 (for clarity shown partially broken away in the drawing) and sufficient liquid such as water is added to the vessel such that the coil is immersed in the liquid.

In the illustrated embodiment, the vessel 36 with contents is placed on a grate 37 such as typically found in campgrounds and the like outdoor environments and a heat source 38 placed beneath the vessel. In the illustrated embodiment, the heat source is an open container containing a combustible fuel which produces a flame upon ignition. Alternatively, the vessel 36 may be placed on a campstove or the like (not shown). Heat from the heat source 38 is then applied to the vessel 36 so as to raise the temperature of its contents. A flow of water is then initiated in tube 12 by opening faucet 16 or starting pump 20.

A particularly preferred use for the apparatus 10 as illustrated in FIGS. 1–3 is as a personal shower, particularly in outdoor environments such as when camping and the like.

Typically, the apparatus would be used in conjunction with a shower enclosure (not shown) such as the type illustrated in the previously discussed patent to Nelson. This enclosure comprises a collapsible metal shower frame having a plastic cloth or layer detachably secured thereto which functions as a shower curtain. The user would first allow the water contained in vessel 36 to reach an elevated temperature and then adjust faucet or pump so as to regulate the flow of water through tube 12 such that the temperature of the water emanating from applicator 26 is comfortable for showering purposes.

Generally, the amount of heat applied to the vessel and the flow of water through tube determine the temperature of the water issuing from applicator 26. Slowing flow down will increase spray temperature slowly while pulsing flow on and off, shutting off the flow, or trickling the flow will increase spray temperature more quickly. Medium flow will tend to maintain a constant temperature from the temperature of the spray at the start of the shower.

As mentioned previously, an important feature of the apparatus 10 in accordance with the present invention is that the tube 12 forming a part of the apparatus is made of a suitable polymeric material. Among other things, polymeric materials have a relatively low rate of heat transfer, particularly as compared with metal. Therefore, the use of polymeric materials tends to allow for a slow transfer of heat from the liquid contained in vessel 36 and thereby tends not to quickly remove all heat added to the liquid by heat source 38. Further, this relatively slow transfer of heat allows the flow of water to the user to be maintained in a comfortable temperature range for longer periods of time, generally a period of time sufficient for a person to take an adequate shower, sometimes even allowing the apparatus to supply an essentially continuous flow of heated water. A further advantage is that is not necessary to provide a source of cool or cold water for mixing with the water heated by apparatus 10 to provide a flow of water from the applicator 26 which is of an appropriate temperature.

Generally speaking, the conditions for operating the subject apparatus may vary considerably as indicated above depending upon, among other things, the type of task being for which the apparatus is being utilized. Thus, for some operations, it is not desirable to provide hot water and/or from the apparatus, but simply ensuring adequate flow of warm water during may be sufficient for showering. On the other hand, it may be advantageous to operate the apparatus such that very hot water and/or steam emanate from the applicator such as when the apparatus is used for cleaning and/or sterilizing.

As previously mentioned, apparatus 10 also may be advantageously used in the cleaning of the surfaces of various articles and objects. For this application, it is generally preferable that the water in vessel is heated to a boil such that the water emanating from the applicator 26 is quite hot and/or contains steam. The application of this extremely hot water and/or steam to an grimy or dirty area of article, particularly when a soap or detergent has been applied to the area, allows for the rapid cleaning thereof. Short bursts of water and/or steam from the applicator 26 have been found to be particularly effective for cleaning purposes.

Although the heating apparatus illustrated in the drawings utilizes a vessel 36 in the form of cooking pot, it is to be recognized that other vessels could be used equally as well for containing a liquid and receiving the coil 34 and allowing for the heating of the same.

A detailed description of a particularly preferred method for making an embodiment of a heating apparatus in accordance with the present invention is set forth in the following.

To a standard piece of 16 mil or the like drip line supply tubing, a hole is punched approximately away from the end using the appropriate punch size. Accommodated in the hole with a good fit is a barbed hose connector for irrigation drip tubing such as 0.170" xc 0.250" Agrifim polyethylene irrigation tubing. One end of the supply tube is plugged using a conventional way to plug up one end. To the other end, a hose bib swivel is placed for easy connection to a garden hose or hose bib. If using a pump of any kind, the end with the hose bib swivel is connected directly or with the swivel to the pressure hose or pressure side of the pump.

In the hole punched in the supply tube, a barbed hose connector is installed and to it is a short or long piece of ¼" polyethylene irrigation tube. Alternatively, a custom made, no drip hose connector that adhesive will stick can be supplied for steam cleaner use without the use of a bucket and the like to place the hose connector and the end of the hose into indoors or outdoors.

At the end of this piece of irrigation tubing, an inline adjustable on-off flow valve used for drip irrigation systems is installed. This valve should be installed right before the line continues on into the water and coil heating area.

For use as an indoor steam cleaner, the valve body and the connecting joints are to be given extra reinforcement using the following method and logic. Enough marine fiberglass resin is mixed to coat the valve body with a thick coat of resin where the drip hose end will slip onto and butt up to making a normal connection. The passage hole through the valve, or the movement of the valve handle with dried resin should not be blocked.

Next, the end of the hose that the valve will slip into is heated over a flame until the end starts showing a slight mushrooming effect at the very end of the hose. At this time, an object shaped like the end of Phillips screw driver is placed into the end of the hose and the end of the tube spread out far enough so that it can be slipped over or mostly over the part of the valve body or coupler where the hose usually butts up against the valve or hose connector during a normal hose connection. The hose is slipped over the valve body or mostly over, the further the better, the surface usually where the hose normally butts to as in a conventional connection.

A fishing line 4 or 6 lb. test approximately 20" long so it is wound around the ¼" hose in the area where the hose is usually slipped over and butted to the valve body. This area between the surface where the hose butts and the barb on a connector or valve body is usually somewhat U-shaped. Using a few or more pounds of pressure, the pressure coming in the form of how hard the fishing line is pulled and stretched as it is tightly wrapped around the hose in the U-shaped area, the line is wound 10 or 15 times at each hose connecting point on a connector coupler or valve body or any part which connects to a drip hose such as an end plug or the like. A knot or a dollop of good glue such as PlastiZap is added to quickly secure the wound line in place.

Marine fiberglass resin is applied to the fishing line to fill in and around the flared tube end for added girth and strength to the connection and the connector valve body. Enough resin is applied so that the resin is fairly thick from the wound line up over the flared tube end down to the valve body or coupler.

To the other end of the valve, that is the outgoing or outflow end, a coil approximately 8 or 9" maximum in diameter of the same ¼" o.d polyethylene tubing is attached, the tubing being approximately 100 to 200 feet long, depending upon the heat transfer characteristics preferred for the particular application. The longer the coil, the more the spray temperature will mirror or equal the pot temperature. The coil can be longer, bigger diameter and larger i.d. for more permanently temporary installations or bigger burner applications using approximately the same volumes, heat and cold water flow ratios. The coil is attached to the valve using the same method of construction for indoor use described above if no drip is desired.

To the other end of the coil, a connector and a piece of vinyl ¼" tubing is attached. The same method for making a joint above for indoor or outdoor steam cleaner use may be used. Then, starting approximately 1" from the end, 5 or 6 holes are made using a very sharp slender pin spike type object, preferably heated to a point that it melts right through the vinyl instead of applying force to the tip. The end is slipped through the tube, reheating as needed. If polyethylene rather than vinyl tubing is used, polyethylene has a tendency to make holes that constrict water flow and thus more holes or bigger holes may need to be made. Preferably, a twelve volt wire tester, the type shaped like a screwdriver that lights up, when used as a pin or spike, makes ideal size holes. Care should be taken to only just penetrate the side of the tube being worked on. The spike or pin should be held plumb to the tube which should be laid on a flat level surface to make a hole. The tube should be moved away from the end an ⅛" or so for each hole.

The end of the hose is clamped and then hot steam water or cold water is run through to check the holes for blockage, initially. When the tube gets hot due to hot water flow, the holes will open up enough for a good spray, after that the holes will be clear. Once the test is done, an end plug commonly used to block ¼" irrigation tubing, is placed in the end. Finally, to the hose connections where fishing line and flared hose ends are used, an ample amount of fiberglass resin is applied to strengthen the winding and support the connectors and to add girth and strength to the valve and connector bodies using the cup shape formed in the tubing because of sliding the tube over the surface used to butt the tubing to under conventional installations.

A detailed description of a particularly preferred method for using an embodiment of a heating apparatus in accordance with the present invention for showering purposes is set forth in the following.

A hose or pump is attached to hose bib or fitting. In a soup pot or the like, liquid, preferably water is filled from the bottom of the pot about a third of the way up, and the pot placed on top of burner, barbecue or camp stove, fire or the like. The coil is placed in water and pushed down to bottom because it floats, such that water covers most of the coil, which is more critical in cold weather below 40° F. The coil can also be placed on its side as opposed to laying flat in the pot. Laying flat, the coil it is only about 3 or 4" high using about a hundred feet and requires less water to heat, which equals faster recovery. Lying on its side has the effect of keeping water coming off the bottom hotter using the same flow and BTU volume because of less contact with the coils in the lower part of the pot thereby keeping temperatures up in the pot more efficiently and increases system performance which is a non-issue for showers unless it is an extremely cold environment. Under the conditions, the coil is laid on its side and the pot filled with water until the coil is covered. In this mode, the pot will be filled with much more water to cover the coils and will take much longer to cool when used as a shower.

A wet towel, sheet or other like item is placed on top of coil, the item being big enough to sink the coil in the desired position. The cavity of the pot is filled to block in heat above the coil and to transfer heat to the coil from the top.

The valve is turned on until a steady flow of water spray is achieved through the hose, and then the valve is turned off. The burner then is turned on. For a camp stove it will take almost ten minutes for the water to be warm enough in the pot to transfer enough heat out of the spray for a good hot shower.

If a finger of the user can be inserted in the water and the user count to five before having to remove the finger from the water in the pot, the water should be close enough in temperature to start the shower with about a 100' coil. Hands should not be placed in the water if steam is present or the water is bubbling. The water is run through the coil until the spray tubing outside the pot is comfortable to touch. If pot water has been left to heat too long and has come to boil, water can be run through the coil and burner heat lowered until hose and water spray are comfortable to touch. Temperatures are checked by touching the spray hose instead of any water if any doubt exists. Then burner and water flow are adjusted for a shower.

Alternatively, the water can be heated for about ten minutes. Water that has been in the coil, if any, is run through. Hands or body parts should not be placed in the spray until bare spray hose is comfortable to touch. If water was in the coil it is extremely hot, or if pot of water is too hot, it will become extremely hot. The pot will slowly cool as water is run though the coil. Adjust burner heat and amount of water flowing through the coil to reach the ideal temperature for the user more quickly.

Once the ideal temperature spray is reached, the burner is turned back up if it is a cold environment and the system is now ready to deliver a consistent temperature throughout the shower with minor adjustment in the volume of water flow. When the ideal temperature is reached for the user, it is evidenced by the temperature of water spray running through and the coil has been cleared of the extremely hot water after the pot is hot, then and only then, start by soaking the head. Then turn water down to a lower flow volume than full to maintain water spray temperature, shut off water to increase temperature of spray quickly if left off for a minute or so. Most likely, the water in the coil will have to be run through the coil a matter of seconds until the spray cools enough to resume the shower.

To gradually increase temperature and continue showering, the pulse spray method may be used by turning water on and off every five to twenty seconds or so or run at a low volume as when one would be keeping warm water on them to stay warm during the shower. During rinsing, if too much water is used for too long, which would be a minute or two on full and the water temperature lowers slightly from what is really wanted, the water volume can be turned down or off for 10 seconds or so and the temperature will recover quickly even in the coldest weather. The pulse method can increase heat dramatically and still keep a person showering extremely comfortable, even down to freezing temperatures. The pot cools gradually during full flow. Knowing this, the water temperature can be maintained as the user will learn to keep the pot hot by monitoring flow through the sense in temperature changes of the spray and the actual need for water for washing, rinsing and staying warm.

Using these methods, great showers are derived with more than plenty of hot water while only using up about 5 gallons of water in the process of a more than comfortable shower.

A detailed description of a particularly preferred method for using an embodiment of a heating apparatus in accordance with the present invention for cleaning purposes is set forth in the following.

Initially, it is to be noted that gloves, eye protection and suitable clothing should be worn when around boiling and steaming water. Using the same instructions for a shower, except fill the pot with the item stuffing the top of the pot and fill with liquid or water so that the liquid is four or five inches from the top of the pot. This is a must because the water, if used as it starts to boil, will expand in the pot just as it does when it goes through the coil it creates a bladder effect with added spray pressure. With the level too high, the water will spill over the sides of the pot. The water is then brought to a boil. Once water is boiling, lower heat enough to maintain boil if short spray blasts are used for steam cleaning things such as carpet spots, spots in clothing, car parts, tools, etc. If longer blasts of steam spray are desired, such as for cleaning barbecues and the like, use more burner heat, under a 125 thousand BTU's will produce extremely long blasts without bringing the pot off boil. A 6 thousand BTU burner will work ideally using short blasts of steam spray.

These methods of steam cleaning will do very adequately for almost any job a high quality washer of any kind can do and more, except remove paint. However, it will clean painted walls beautifully, etc.

While there has been shown and described what are considered to be preferred embodiments of the present invention, it will be apparent to those skilled in the art to which the invention pertains that various changes and modifications may be made therein without departing from the invention as defined in the appended claims.

It is claimed:

1. An apparatus for use in heating a fluid, the apparatus comprising an elongated tube formed of polymeric material and having two ends, one of the ends having a fitting attached thereto, the fitting being adapted to secure the apparatus in a fluid-tight manner to a source of a fluid flow, the other end of the tube having an applicator which includes one or more holes for the discharge of fluid flowing through the tube, and a valve disposed intermediate the ends of the tube, a portion of the elongated tube being formed into a coil.

2. The apparatus in accordance with claim 1, further including a vessel which contains the portion of the tube formed into a coil.

3. The apparatus in accordance with claim 1, wherein the tube is of a polyethylene containing material.

4. The apparatus of claim 1, further including a pump for supplying a flow of fluid to said tube.

5. The apparatus in accordance with claim 4, further including a vessel which contains the portion of the tube formed into a coil.

6. The apparatus in accordance with claim 5, wherein the tube is of a polyethylene containing material.

7. A method for taking a shower, the method comprising:

providing an apparatus for use in heating a fluid, the apparatus comprising an elongated tube formed of polymeric material and having two ends, one of the ends having a fitting attached thereto, the fitting being adapted to secure the apparatus in a fluid-tight manner to a source of a fluid flow, the other end of the tube having an applicator which includes one or more holes for the discharge of fluid flowing through the tube, a valve disposed intermediate the ends of the tube, a portion of the elongated tube being formed into a coil and a vessel which contains the portion of the tube formed into a coil along with a liquid;

heating the liquid in the vessel;

supplying fluid so as to flow through the tube from the fitting end to the applicator end;

applying the fluid emanating from the holes to a human.

8. The method in accordance with claim 7, wherein the tube is of a polyethylene containing material.

9. The method of claim 7, wherein a pump is used for supplying a flow of fluid through said tube.

10. A method for cleaning a surface of an object, the method comprising:

providing an apparatus for use in heating a fluid, the apparatus comprising an elongated tube formed of polymeric material and having two ends, one of the ends having a fitting attached thereto, the fitting being adapted to secure the apparatus in a fluid-tight manner to a source of a fluid flow, the other end of the tube having an applicator which includes one or more holes for the discharge of fluid flowing through the tube, a valve disposed intermediate the ends of the tube, a portion of the elongated tube being formed into a coil and a vessel which contains the portion of the tube formed into a coil along with a liquid;

heating the liquid in the vessel;

supplying fluid so as to flow through the tube from the fitting end to the applicator end;

applying the fluid emanating from the holes to the surface of the object to be cleaned.

11. The method in accordance with claim 10, wherein the tube is of a polyethylene containing material.

12. The method of claim 10, wherein a pump is used for supplying a flow of fluid through said tube.

* * * * *